United States Patent [19]

Kimura

[11] Patent Number: 4,909,036

[45] Date of Patent: Mar. 20, 1990

[54] EXHAUST SYSTEM FOR INTERNAL COMBUSTION ENGINE WITH COMPRESSION WAVE SUPERCHARGER

[75] Inventor: Kiyomi Kimura, Hiroshima, Japan

[73] Assignee: Mazda Motor Corporation, Hiroshima, Japan

[21] Appl. No.: 327,731

[22] Filed: Mar. 23, 1989

[30] Foreign Application Priority Data

Mar. 24, 1988 [JP] Japan ..... 63-71583

[51] Int. Cl.[4] ..... F02B 37/02

[52] U.S. Cl. ..... 60/605.2; 123/568

[58] Field of Search ..... 123/559.1, 568, 569; 60/605.2

[56] References Cited

U.S. PATENT DOCUMENTS

| | | | |
|---|---|---|---|
| 4,555,904 | 12/1985 | Melzer et al. | 60/605.2 |
| 4,676,217 | 6/1987 | Yajima | 123/559.1 |
| 4,697,423 | 10/1987 | Conrad et al. | 60/605.2 |
| 4,702,218 | 10/1987 | Yoshioka et al. | 60/605.2 |

FOREIGN PATENT DOCUMENTS

| | | | |
|---|---|---|---|
| 0129245 | 8/1982 | Japan | 60/605.2 |
| 1296737 | 3/1987 | U.S.S.R. | 60/605.2 |
| 0941532 | 11/1963 | United Kingdom | 60/605.2 |

*Primary Examiner*—Willis R. Wolfe

*Attorney, Agent, or Firm*—Fleit, Jacobson, Cohn, Price, Holman & Stern

[57] ABSTRACT

An engine exhaust system wherein exhaust manifold comprises a plurality of exhaust branch connected to the engine at upstream ends to form a plurality of forked exhaust passage means respectively, converging portion for converging said plurality of exhaust branch to form a single converged exhaust passage, and exhaust outlet for introducing the exhaust gas from the exhaust manifold to compression wave supercharger, the exhaust branch being arranged in such a manner that respective streams of the exhaust gas through the exhaust branch are converged to form a substantially single stream in the converging portion, EGR port being arranged on the exhaust manifold means so as to substantially align with the single stream, the exhaust outlet being arranged in a direction different from that of the single stream of the exhaust gas, the system can highly utilize a dynamic energy of the exhaust gas in EGR control on one hand, and can suppress an influence of pulsation of the exhaust gas in operation of the compression wave supercharger on the other hand.

12 Claims, 5 Drawing Sheets

EXHAUST SYSTEM FOR INTERNAL COMBUSTION ENGINE WITH COMPRESSION WAVE SUPERCHARGER

BACKGROUND OF THE INVENTION

1. Field of the Invention

This invention relates to an exhaust system for an internal combustion engine with so called compression wave supercharger in which a compression wave energy of an exhaust gas is utilized for compressing an intake gas to get a supercharging effect of the intake gas, more specifically to an exhaust system in which an exhaust gas recirculation (hereinafter referred to as EGR) port for introducing EGR gas therefrom is provided.

2. Description of the Prior Art

An exhaust system with a compression wave supercharger is disclosed in for example, Japanese Patent Public Disclosure No. 61-31652, laid open to the public on Feb. 14, 1986, which corresponds to U.S. Pat. No. 4,702,218 wherein the exhaust system is provided with an EGR control system for reducing Nox in the exhaust gas.

The compression wave supercharger disclosed in the above Japanese publication is provided with a casing, a rotor rotatably mounted on the case, provided with a plurality of radially extending partitions to define a plurality of axially extending gas chambers. The casing is provided with opposite ends facing to the rotor wherein one of the end of the casing is formed with an inlet and outlet for the exhaust gas and the other end is formed with an inlet and outlet for the intake gas. The exhaust gas is introduced into the gas chambers of the rotor rotating to compress the intake gas by utilizing the exhaust gas energy for thereby obtaining a supercharging effect. The exhaust system disclosed in the Japanese publication is also provided with an EGR port to which an EGR passage is connected for introducing an EGR gas thereinto.

In such an exhaust system of the engine with the compression wave supercharger and the EGR control system, in utilizing energy of the exhaust gas, it is desirable on one hand to suppress a pulsation effect or dynamic effect of the compression wave of the exhaust gas introduced in the gas chambers of the rotor wherein the pulsation of the exhaust gas is produced because of, for example, the different operating phases of respective cylinders in a reciprocating engine and of rotors in a rotary piston engine so that a uniform supercharging effect can be obtained. On the other hand, it is desirable to take advantage of the pulsation effect of the compression wave so that the EGR gas can be effectively introduced into the EGR passage.

It should however be noted that the conventional exhaust systems of the engine with both the compression wave supercharger and the EGR control system is not sufficient in obtaining both a desirable supercharging effect and an efficient introduction of the EGR gas.

SUMMARY OF THE INVENTION

It is therefore a primary object of the present invention to provide an exhaust system for an internal combustion engine with both a compression wave supercharger and an EGR control system can obtain both a desirable supercharging effect of the intake gas and an efficient introduction of the EGR gas to the EGR passage and to the engine.

It is another object of the present invention to provide an exhaust system for an internal combustion engine with both a compression wave supercharger and an EGR control system which is not affected by the pulsation of the compression wave of the exhaust gas.

It is still another object of the present invention to provide an exhaust system which can effectively introduce the EGR gas into an EGR gas passage taking advantage of an energy of the exhaust gas.

According to the present invention, the above and the other objects of the invention can be accomplished by an internal combustion engine comprising intake passage means for introducing an intake gas to the engine, exhaust passage means for conducting an exhaust gas from the engine, compression wave supercharger means for supercharging the intake gas by taking advantage of an energy of the exhaust gas, EGR port means provided on the exhaust passage means between the engine and the compression wave supercharger means for introducing the exhaust gas from the exhaust passage means to the intake passage means through EGR passage means, exhaust manifold means disposed in the exhaust passage means between the engine and the compression wave supercharger for constituting a part of the exhaust passage means, the improvement wherein the exhaust manifold means comprises a plurality of exhaust branch means connected to the engine at upstream ends thereof to form a plurality of forked exhaust passage means respectively, converging means for converging said plurality of exhaust branch means to form a single converged exhaust passage means, and exhaust outlet means for introducing the exhaust gas from the exhaust manifold means to the compression wave supercharger, the exhaust branch means being arranged in such a manner that respective streams of the exhaust gas through the exhaust branch means are converged to form a substantially single stream in the converging means, the EGR port means being arranged on the exhaust manifold means so as to substantially align with said single stream, the exhaust outlet means being arranged in a direction different from that of said single stream of the exhaust gas.

According to the present invention, the EGR port is provided on the manifold means substantially in align with the single stream line into which the respective streams of the exhaust gas from the engine in the respective exhaust branch means are converged so that a dynamic energy of the exhaust gas can be highly utilized to facilitate an introduction of the EGR gas to an EGR control system or to an intake system. This improves the EGR efficiency. On the other hand, the exhaust outlet means is arranged in the manifold means in a manner that an influence of the dynamic energy of the exhaust gas flowing in the exhaust passage can be suppressed as low a possible. For instance, the exhaust outlet means may be oriented in a direction different from that of the single stream produced as a result of merging the exhaust gas from the respective exhaust branch means. As a result, a pulsation of the exhaust gas does not affect the supercharging by the pressure of the exhaust gas in the compression wave supercharger so that a desirable supercharging effect can be obtained.

The above and other objects and features of the present invention will become apparent from the following description in connection with the preferred embodiment taking reference with the accompanying drawings.

DESCRIPTION OF THE PREFERRED EMBODIMENTS

Figure 1:
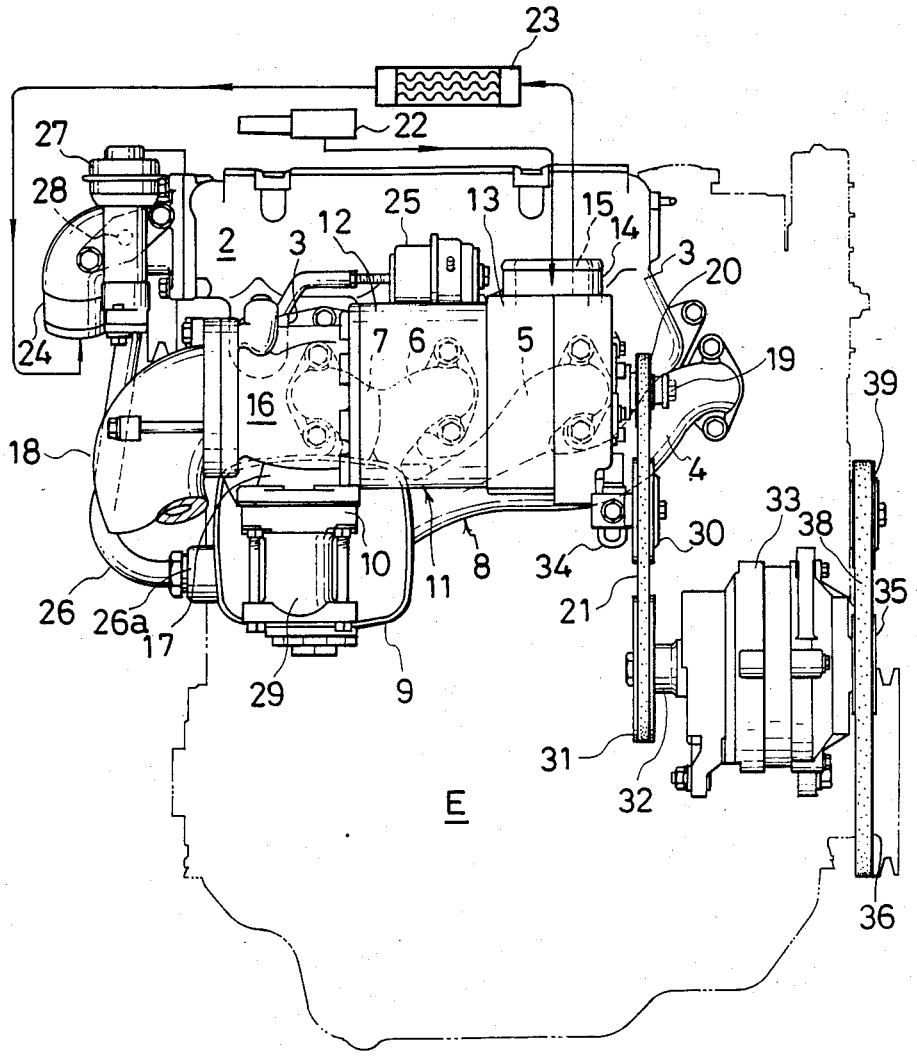
FIG. 1 is a front view of an exhaust system mounted on an engine in accordance with a preferred embodiment of the present invention.
Figure 2:
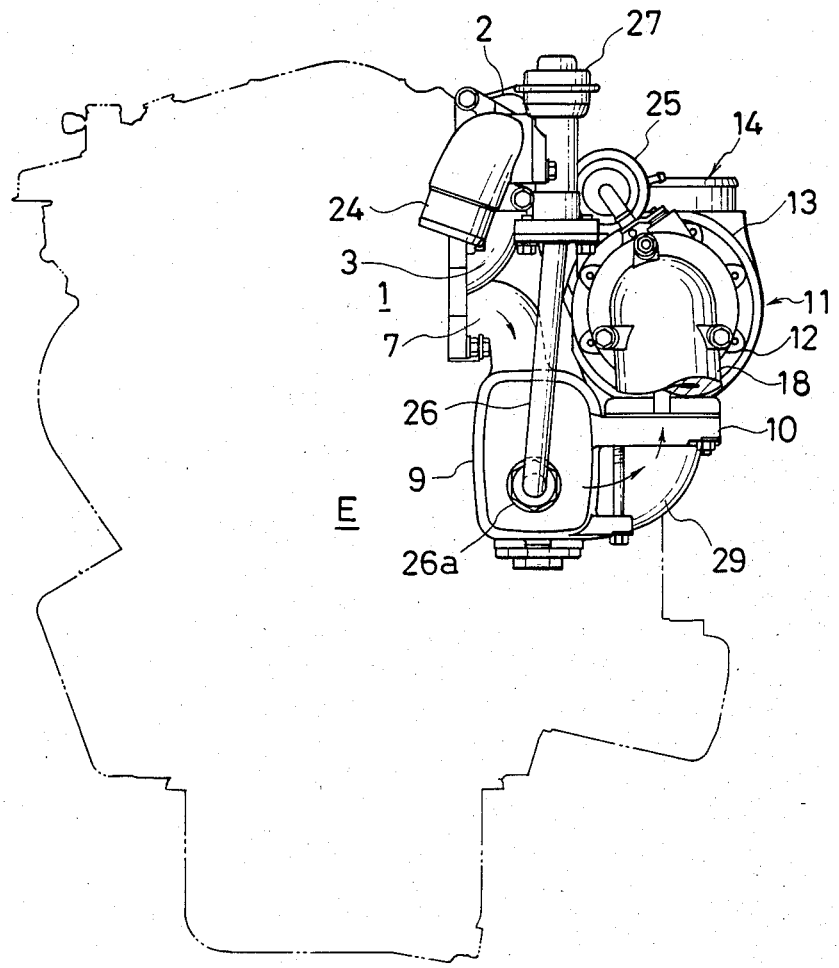
FIG. 2 is a side view of the exhaust system of FIG. 1.

Referring to the drawings, specifically to FIG. 1 and FIG. 2, there is shown an illustrative Diesel engine E to which the present invention is applied.

The engine E is of a so called same flow cylinder wherein both intake ports and exhaust ports of respective cylinders are located on one side of a cylinder head 1 thereof with regard to a direction along which the cylinders are arranged or an axial direction of a crank shaft.

Figure 3:
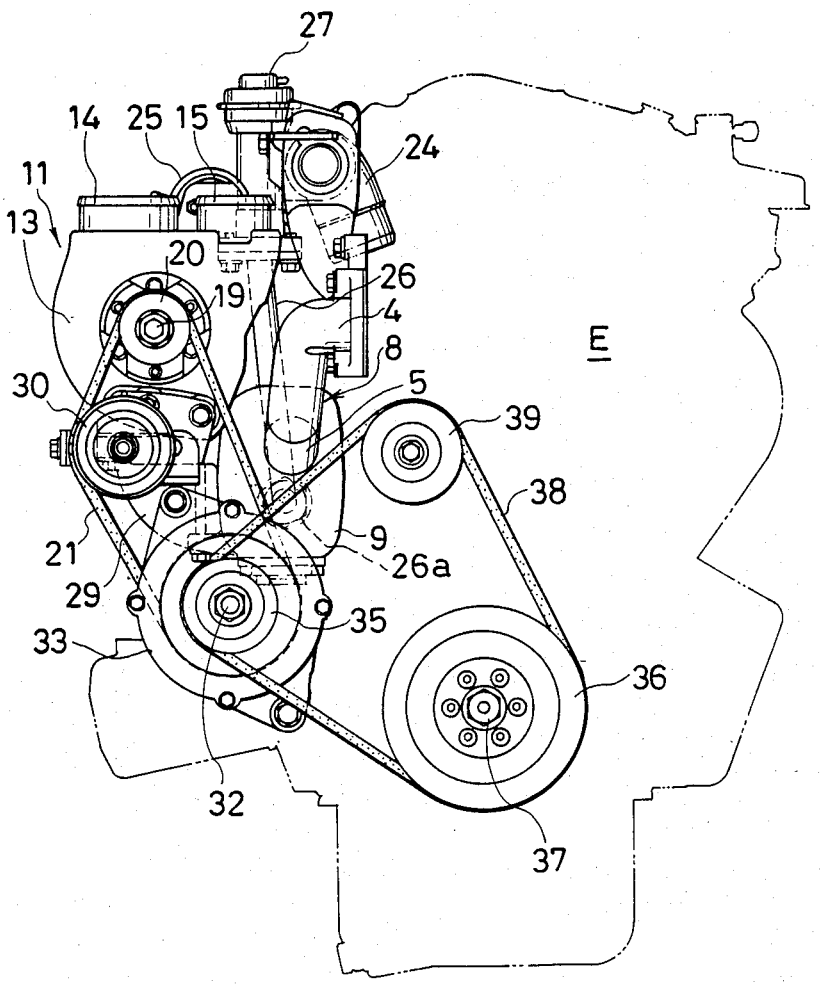
FIG. 3 is a side view of the exhaust system similar to FIG. 2 but showing the opposite side thereof.

On the cylinder head 1 are mounted an intake manifold 3 connected with a surge tank 2 and an exhaust manifold 8 provided with exhaust branch passages 4, 5, 6 and 7 which are communicated with the exhaust ports of the respective cylinders. An exhaust chamber 9 or enlarged portion of a certain capacity is formed integrally with a merging portion of the exhaust manifold 8 in which the exhaust branch passages 4, 5, 6 and 7 are merged to form a single exhaust passage. There is arranged a compression wave supercharger 11 over the exhaust chamber 9 in the exhaust passage. The compression wave supercharger 11 comprises a rotor casing 12 in which a rotor is arranged and an air casing 13 having an intake gas inlet 14 and an intake gas outlet 15, and an exhaust gas casing 16 joined integrally with a rear side of the rotor casing 12 and having an exhaust gas inlet 17 and an exhaust gas outlet 18. The rotor is carried by a rotor shaft 19 which extends through the air casing 13. Referring further to FIG. 3, on the rotor shaft 19 is mounted a rotor pulley 20 which is engaged through a belt 21 and an idler pulley 30 with a pulley 31 mounted on an end of a drive shaft 32 of an alternator 33 wherein the idler pulley 30 is fixed to the air casing 13 through a bracket 34. On the other end of the drive shaft 32, there is mounted a drive pulley 35 of the alternator 33. A crank pulley 36 is mounted on a crank shaft 37. The drive pulley 35 of the alternator 33 is engaged with the crank pulley 36 through a belt 38 which also engages an idler pulley 39 therewith so that the drive shaft of the alternator 32 is driven by an engine output through the belt 38 and thus the rotor is driven by the engine output through the belt 21.

As for an intake system of the engine E, an air cleaner 22 is arranged upstream of the air casing 13 and is connected with the intake gas inlet 14 thereof is arranged an inter cooler 23 in an intake passage downstream of the air outlet 15 of the air casing 13. The inter cooler 23 is connected with the surge tank 2 through an inlet portion or joint portion 24 which is smaller than the surge tank in section.

An exhaust system of the engine E is provided with a waste valve control device 25 for controlling an amount of the exhaust gas introduced into the rotor, and a silencer (not shown).

The exhaust gas inlet 17 of the gas casing 16 is communicated with the exhaust chamber 9 integrally formed with the exhaust manifold 8 through an arched connecting passage 29 having a connecting flange 10 with which the intake gas casing 12 of the supercharger 11 is connected.

An EGR passage 26 constituted by a L shaped tube for conducting EGR gas from the exhaust system to the intake system is connected to the exhaust chamber 9. In order to receive the EGR gas, there is provided an inlet port 28 in the joint portion 24 of the surge tank 2 through an EGR valve 27 arranged at a top portion of the EGR passage 26 for controlling an amount of the EGR gas so that the EGR gas is introduced into the intake passage. Since the inlet port 28 for the EGR gas is provided on the joint portion 24 which is smaller than the surge tank 2, a flow speed of the intake gas is higher than that in the surge tank so that introduction of the EGR gas into the intake passage is facilitated because of a high draft force by virtue of the higher speed of the flow.

Figure 4:
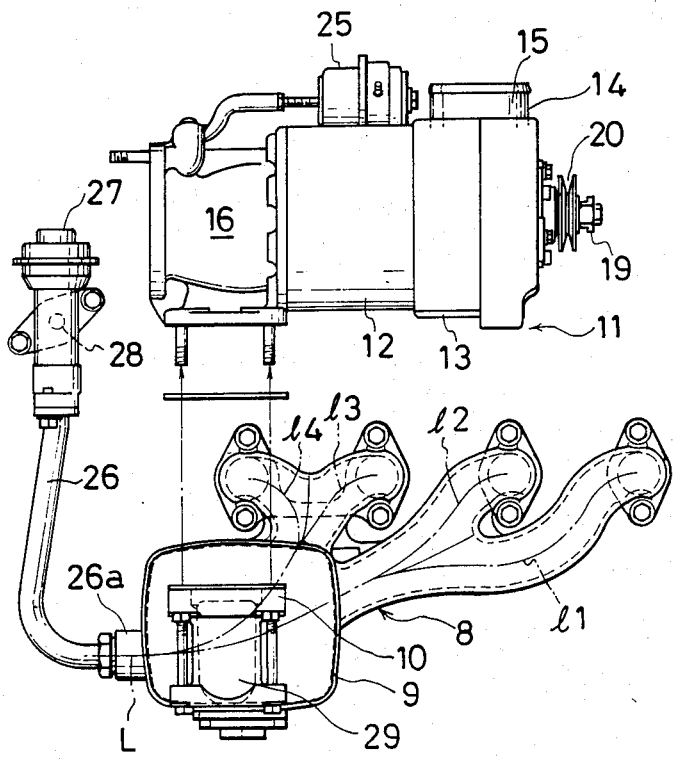
FIG. 4 is an exploded front view of the exhaust system specifically showing an exhaust manifold and a compression wave supercharger.
Figure 6:
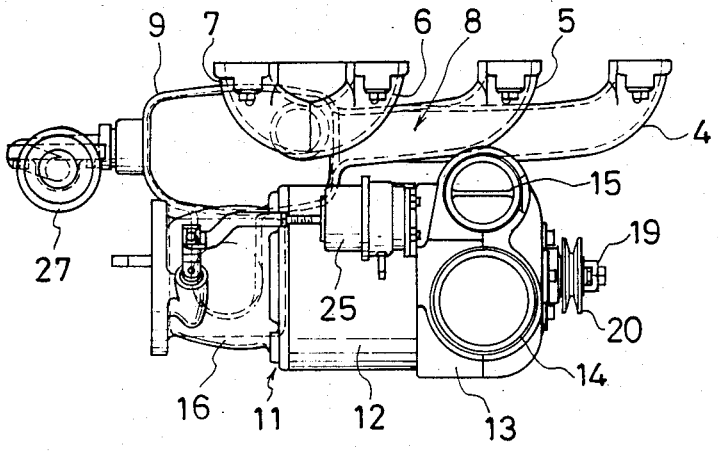
FIG. 6 is a plan view of the exhaust system specifically showing the compression wave super charger and the exhaust manifold.

Clearly shown in FIGS. 4 and 6, the exhaust branch passages 4, 5, 6 and of the manifold 8 are integrally formed with the chamber 9 in such an arrangement that stream lines 11, 12, 13 and 14 of the exhaust gas from the respective cylinders are converged into a single stream line L in the chamber 9. In addition, an EGR port 26*a* for introducing the EGR gas into the EGR passage 26 is substantially aligned with the converged stream line L of the exhaust gas so as to effectively get a pulsation effect of the exhaust gas produced as a result of different operating phases of the respective cylinders. This is more effective in introducing the EGR gas in a Diesel engine than a gasoline engine since the intake gas pressure of the Diesel engine is generally higher than the gasoline engine.

Figure 5:
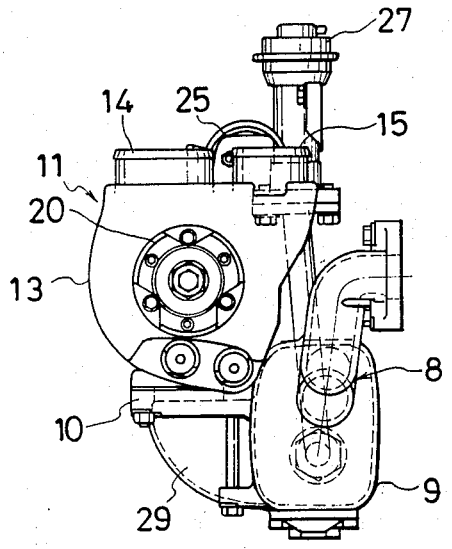
FIG. 5 is a side view of the exhaust system specifically showing the compression wave supercharger and the exhaust manifold.

Further referring to FIG. 5, the connecting passage 29 is oriented substantially in a normal direction to the stream line L. In other words, an outlet of the chamber 9 for the exhaust gas is arranged in a direction which is not aligned with the stream line L so that an influence of the pulsation effect from the exhaust gas in the chamber can be suppressed as low as possible. As a result, a pressure balance of the intake gas and the exhaust gas can be improved in gas chambers of the rotor so that a desirable supercharging effect can be obtained.

In the illustrated structure, an upstream end portion of the surge tank 2 is substantially aligned with an downstream end of the exhaust chamber 9 with regard to a direction of the crank shaft 37 extending so that the EGR passage 26 can be easily connected with the intake passage upstream of the surge tank 2 with a simple structure. This facilitates a compact engine, intake and exhaust layout.

In operation of the compression wave supercharger 11, the exhaust gas is introduced into the respective gas chambers of the rotor sequentially from one end of the rotor through the exhaust gas inlet 17 as the rotor is rotated by virtue of the engine power. At the same time, the intake gas is introduced into the gas chambers of the rotor from the intake gas inlet 14 and compressed by the pressure wave of the exhaust gas when the intake gas is brought into contact with the exhaust gas in the respective gas chambers and thereafter the supercharged intake gas is discharged from the intake gas outlet 15. On the other hand, the exhaust gas is discharged from the exhaust gas casing 16 through the outlet 18.

While the invention has been specifically described in connection with preferred embodiments thereof, it will be understood by those skilled in the art that the foregoing and other changes or modifications in form and details can be made therein without departing from the spirit and scope of the invention.

I claim:

1. An internal combustion engine comprising intake passage means for introducing an intake gas of the engine, exhaust passage means for conducting an exhaust gas from the engine, compression wave supercharger means for supercharging the intake gas by taking advantage of an energy of the exhaust gas, EGR port means provided on the exhaust passage means between the engine and the compression wave supercharger means for introducing the exhaust gas from the exhaust passage means to the intake passage means through EGR passage means, exhaust manifold means disposed in the exhaust passage means between the engine and the compression wave supercharger for constituting a part of the exhaust passage means, the improvement wherein the exhaust manifold means comprises a plurality of exhaust branch means connected to the engine at upstream ends thereof to form a plurality of forked exhaust passage means respectively, converging means for converging said plurality of exhaust branch means to form a single converged exhaust passage means, and exhaust outlet means for introducing the exhaust gas from the exhaust manifold means to the compression wave supercharger, the exhaust branch means being arranged in such a manner that respective streams of the exhaust gas through the exhaust branch means are converged to form a substantially single stream in the converging means, the EGR port means being arranged on the exhaust manifold means so as to substantially align with said single stream, the exhaust outlet means being arranged in a direction different from that of said single stream of the exhaust gas.

2. An internal combustion engine in accordance with claim 1 wherein the converging means comprises exhaust chamber means of a certain capacity in which the respective streams of the exhaust gas through the exhaust branch means are converged to form a substantially single stream of the exhaust gas.

3. An internal combustion engine in accordance with claim 1 wherein the improvement further comprises intake manifold means having surge tank means, a plurality of intake branch means extending from the surge tank means to be connected to the engine, inlet means smaller than the surge tank means in section provided in the intake passage means upstream of the surge tank means and connected upstream end of the surge tank means, and having EGR introducing means formed on the inlet means for introducing the EGR gas into the intake passage means.

4. An internal combustion engine in accordance with claim 1 wherein the improvement further comprises intake manifold means having common intake passage means for constituting a single intake passage in which the intake gas passes through and a plurality of intake branch means provided downstream of the common intake passage means to extend therefrom and connected to the engine for constituting individual intake passages which introduce the intake gas into cylinders of the engine respectively, the common intake passage means of the intake manifold means extending in an axial direction of a crank shaft of the engine and offset to one side of the engine with regard to said axial direction of the crank shaft, said intake branch means being arranged in said one side of the engine, the intake manifold means being formed with EGR introducing means for introducing the exhaust gas into the intake passage means at an upstream portion of the intake manifold.

5. An internal combustion engine in accordance with claim 2 wherein the exhaust chamber means is of a substantially box configuration in which a height is larger than a width thereof, at least a part of the exhaust chamber means being arranged in a space between the engine and the compression wave supercharger, the EGR port means being located in the vicinity of a lower corner portion of the exhaust chamber means at one side of the engine with regard to the axial direction of the crank shaft, said substantially single stream of the exhaust gas being introduced into the exhaust chamber means at an upper corner portion of the exhaust chamber means which is diagonally spaced from said lower corner portion.

6. An internal combustion engine in accordance with claim 2 wherein the engine comprises a plurality of cylinders and intake manifold means having common intake passage means for constituting a single intake passage in which the intake gas passes through and a plurality of intake branch means provided downstream of the common intake passage means to extend therefrom and connected to the engine for constituting individual intake passages which introduce the intake gas into the cylinders of the engine respectively, the common intake passage means of the intake manifold means extending in an axial direction of a crank shaft of the engine and offset to one side of the engine with regard to said axial direction of the crank shaft, each of the cylinder being formed with intake port means for introducing the intake gas thereinto and exhaust port means for discharging the exhaust gas therefrom at one side of the engine, said common intake passage means being formed with EGR introducing means for introducing the exhaust gas into the intake passage means at an upstream portion thereof, said EGR introducing means being connected with said EGR port means through the EGR passage means in said one side of the engine.

7. An internal combustion engine in accordance with claim 3 wherein both said EGR introducing means and EGR port mean are located at one side of the engine with regard to an axial direction of a crank shaft.

8. An internal combustion engine in accordance with claim 4 wherein both said intake manifold means and exhaust manifold means are located at one side of the engine with regard to an direction of a crank shaft.

9. An internal combustion engine in accordance with claim 5 wherein said compression wave supercharger is provided with exhaust casing means mounted thereon at one side thereof in an axial direction of a crank shaft for constituting a part of the exhaust passage means, the EGR port means being provided on the exhaust casing means, said EGR passage means being constituted by L shaped pipe means extending upwardly from the EGR port means and provided above the exhaust casing means with EGR valve means for controlling the exhaust gas passing therethrough.

10. A internal combustion engine in accordance with claim 5 wherein said intake passage means comprises surge tank means, a plurality of intake branch means extending from the surge tank means and connected to the engine, inlet means smaller than the surge tank means in section and connected to an upstream end of the surge tank means, the inlet portion being formed with EGR introducing means for introducing the exhaust gas into the intake passage means, the surge tank passage means extending in an axial direction of a crank shaft of the engine and offset to one side of the engine with regard to said axial direction of the crank shaft, each cylinder of the engine being formed with intake port means for introducing the intake gas thereinto and exhaust port means for discharging the exhaust gas therefrom at said one side of the engine, said EGR introducing means being connected with said EGR port means through the EGR passage means in said one side of the engine.

11. An internal combustion engine in accordance with claim 6 wherein the improvement further comprises intake manifold means having surge tank means, a plurality of intake branch means extending from the surge tank means to be connected to the engine, inlet means smaller than the surge tank means in section provided in the intake passage means upstream of the surge tank means and connected upstream end of the surge tank means, and having EGR introducing means formed on the inlet means for introducing the EGR gas into the intake passage means.

12. An internal combustion engine in accordance with claim 10 wherein said compression wave supercharger is provided with exhaust casing means mounted thereon at one side thereof in an axial direction of a crank shaft for constituting a part of the exhaust passage means, the EGR port means being provided on the exhaust casing means, said EGR passage means being constituted by L shaped pipe means extending upwardly from the EGR port means and provided above the exhaust casing means with EGR valve means for controlling the exhaust gas passing therethrough.

* * * * *